US010774500B2

(12) United States Patent
Harder et al.

(10) Patent No.: US 10,774,500 B2
(45) Date of Patent: Sep. 15, 2020

(54) POWER OPERATED LOCKING SYSTEM EARTH MOVING EQUIPMENT AND METHOD

(71) Applicant: Caterpillar Inc., Peoria, IL (US)

(72) Inventors: Craig Edward Harder, Edmonton (CA); Paul Daniel Weber, Edmonton (CA)

(73) Assignee: Caterpillar Inc., Peoria, IL (US)

( * ) Notice: Subject to any disclaimer, the term of this patent is extended or adjusted under 35 U.S.C. 154(b) by 320 days.

(21) Appl. No.: 15/911,889

(22) Filed: Mar. 5, 2018

(65) Prior Publication Data

US 2018/0258607 A1 Sep. 13, 2018

Related U.S. Application Data

(60) Provisional application No. 62/469,027, filed on Mar. 9, 2017.

(51) Int. Cl.

| | |
|---|---|
| ***E02F 3/40*** | (2006.01) |
| ***E02F 3/407*** | (2006.01) |
| ***E02F 3/96*** | (2006.01) |
| ***E02F 9/28*** | (2006.01) |

(52) U.S. Cl.

CPC ..... *E02F 3/401* (2013.01); *E02F 3/407* (2013.01); *E02F 3/962* (2013.01); *E02F 9/2808* (2013.01)

(58) Field of Classification Search

CPC ..... E02F 9/2808; E02F 9/2816; E02F 9/2825; E02F 9/2833; E02F 3/401; E02F 3/407; E02F 3/962

See application file for complete search history.

(56) References Cited

U.S. PATENT DOCUMENTS

| | | | | | |
|---|---|---|---|---|---|
| 2,390,286 | A * | 12/1945 | Clinton | B65G 65/00 | 198/308.1 |
| 4,413,432 | A * | 11/1983 | Bierwith | E02F 9/2825 | 37/456 |
| 5,049,027 | A * | 9/1991 | Morrison | E02F 3/3636 | 414/723 |
| 5,063,696 | A * | 11/1991 | Smith | E02F 9/2833 | 37/446 |
| 5,159,312 | A * | 10/1992 | Engle | B60D 1/36 | 307/9.1 |
| 5,311,681 | A * | 5/1994 | Ruvang | E02F 9/2841 | 37/452 |
| 5,435,084 | A * | 7/1995 | Immel | E02F 9/2841 | 172/713 |
| 5,937,550 | A * | 8/1999 | Emrich | E02F 9/2841 | 37/458 |
| 6,588,965 | B1 * | 7/2003 | Keech | E02F 9/2841 | 403/31 |

(Continued)

*Primary Examiner* — Jamie L McGowan

(74) *Attorney, Agent, or Firm* — Law Office of Kurt J. Fugman LLC

(57) ABSTRACT

A power operated locking device for securing for example a tooth or an adaptor, to a ground engaging system, the lock having an internal motor, and sensing system operated by remote wireless technology to unlock and lock the locking device, and a wireless transmitting handheld device for the locking, and unlocking of the power operated locking device, wherein the motor and drive and electronic response circuits are all contained within the power operated locking device.

15 Claims, 5 Drawing Sheets

(56) References Cited

U.S. PATENT DOCUMENTS

| | | | | |
|---|---|---|---|---|
| 6,870,485 | B2 * | 3/2005 | Lujan | E02F 9/24 340/480 |
| 9,249,558 | B2 * | 2/2016 | Bierwith | E02F 9/2833 |
| 2004/0060435 | A1 * | 4/2004 | Maher | E02F 9/2833 92/100 |
| 2004/0216334 | A1 * | 11/2004 | Emrich | H03K 19/0019 37/452 |
| 2004/0255493 | A1 * | 12/2004 | Friberg | E01H 5/045 37/260 |
| 2012/0055052 | A1 * | 3/2012 | Campomanes | E02F 9/2825 37/456 |
| 2015/0096207 | A1 * | 4/2015 | Tasovski | E02F 9/2841 37/456 |
| 2017/0314235 | A1 | 11/2017 | Knight | |
| 2017/0370076 | A1 * | 12/2017 | Campomanes | E02F 9/2833 |

* cited by examiner

POWER OPERATED LOCKING SYSTEM EARTH MOVING EQUIPMENT AND METHOD

This application is based on U.S. provisional application Ser. No. 62/459,027 title "POWER OPERATED LOCKING DEVICE EARTH MOVING EQUIPMENT AND METHOD" filed Mar. 9, 2017 the priority of which is claimed.

FIELD OF THE INVENTION

The invention relates to earth moving equipment and machinery and in particular to the retention of for example teeth on such earth moving machinery. In particular, the invention relates to new power operated locking systems in such teeth, operated by remote wireless for moving individual locking mechanisms between locked and unlocked positions. The locking system according to the invention is concealed entirely within the components of the earth moving machinery such as tooth mounts and the teeth themselves, so that the locking systems are not exposed in the environment in which the machinery is used.

BACKGROUND OF THE INVENTION

Many machines particularly earth moving machines, include ground engaging tools for performing tasks like digging, tilling, ripping, loading, and/or excavation tasks and the like. Such ground engaging tools often include a shovel or scoop with one or more lips with edges on them. If such lips are left unprotected, contact with soil, rock and other materials may damage or wear the edges of the lips. Repairing or replacing the lip of such a ground engaging tool due to wear or damage of the edge may involve significant expense. Accordingly, many ground engaging tools include ground engaging members such as teeth, adaptors, and shrouds which are mounted to the lip to shield the edge of the lip from contact with soil, rock, and other materials.

In most cases such teeth and adaptors were secured to the shovel by some form of wedge-like device. In many cases such wedges were secured in place manually, often by simply hammering. In other cases, various different locks or wedge systems were developed, in which the wedging was effected by means of some form of threaded mechanism. The threaded mechanism, in turn, was operated by hand, or with a wrench.

It will be understood that even the more complex threaded mechanisms for locking the teeth on the adaptors, still had to be accessible from the exterior of the tooth or adaptor or both. This was admitted as a possible cause of problems, due to the harsh environment of alternately moving the shovel into the earth or debris and then removing it again. The teeth and the mechanisms were subject to extreme abrasion and forces operating first to push the teeth on and then pull the teeth off the adaptors and so on.

As and when the teeth have to be replaced, then the shovel would have to be cleaned up to make the removal mechanism accessible. In the event that the locking mechanism had become damaged due to use, then removing such locking mechanism in turn became a problem.

The present invention overcomes these problems concealing the entire locking mechanism within the body of the adaptor and of the tooth, and making the locking mechanism independently responsive to wireless technology from outside the tooth and adaptor.

BRIEF SUMMARY OF THE INVENTION

The present invention provides a shovel for earth moving equipment of the type having a shovel lip and a plurality of ground engaging tool bits removably attached to said lip and comprising: a tool bit mount on said shovel lip, a tool bit releasably carried on said tool bit mount; a lock receiving recess in the interior of said tool bit mount; a power operated tool bit lock received in said lock receiving recess in said tool bit mount, said power operated tool bit lock incorporating a moveable lock member, and an electrical power operated drive operable to drive said lock member between two positions, a lock receiving socket in the interior of said tool bit oriented to register with said lock receiving recess in said tool bit mount to receive said lock member, a remote control device operable from adjacent to said shovel lip exterior to said tool bit mount and said tool bit and signal said electrical power operated drive means.

The invention also provides a tool lock which is provided with integral power operated locking and unlocking mechanisms, which are independently and separately operable by wireless remote technology and is therefore both hammerless and requires no hand tools for securing for example a tooth or an adaptor, to a ground engaging system.

The lock utilizes an internal motor, and sensing system operated by remote wireless technology such as Wi-Fi, Bluetooth, RFID, and/or other wireless transmitting signal to unlock and lock the mechanical hammer less locking system. The wireless transmitting signal is transmitted via a handheld device such as a mobile phone, tablet, key fob, and/or other such handheld devices, for the locking (installation), and unlocking (removal) of the power operated locking system within the tool bit mount and tool bit.

The motor and drive and electronic response circuits are all contained within the power operated locking device.

Thus each power operated device contains its own integral motor and drive and locking member which is movable between locking and unlocking positions by the motor, and are all contained within the interior of the body of each of the tool bit mounts and/or adaptor, and are not accessible from the exterior.

The locking assembly has a steel bar or lock, that after the tooth or adaptor is positioned, is activated by a remote wireless signal and slides out from the assembly, locking the tooth to the adaptor, or locking the adaptor to the shovel.

The wireless transmitting signal is transmitted to the locking assembly, which is housed, encased, and/or shrouded within the adaptor nose or other tool bit mounting system. There may be twenty or more such teeth, and adaptors, on a shovel, for example.

Each locking assembly will respond to a specific unique coded signal from the wireless transmitter device, using current encoding signal systems.

In this way the operator can open one such locking device at a time.

Preferably, each locking member is operated by its own individual rack and pinion gear system driven by its own individual motor and battery.

It will, of course, be understood that the shovel or other piece of equipment also has individual tooth mounts or adaptors or connectors secured to it, each of which has a suitable interior recess for receiving a power operated lock of the type described.

The invention also provides a method of locking and unlocking a tool bit on a shovel. The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As already explained the invention provides a power operated lock for use on earth moving machinery.

Figure 9:
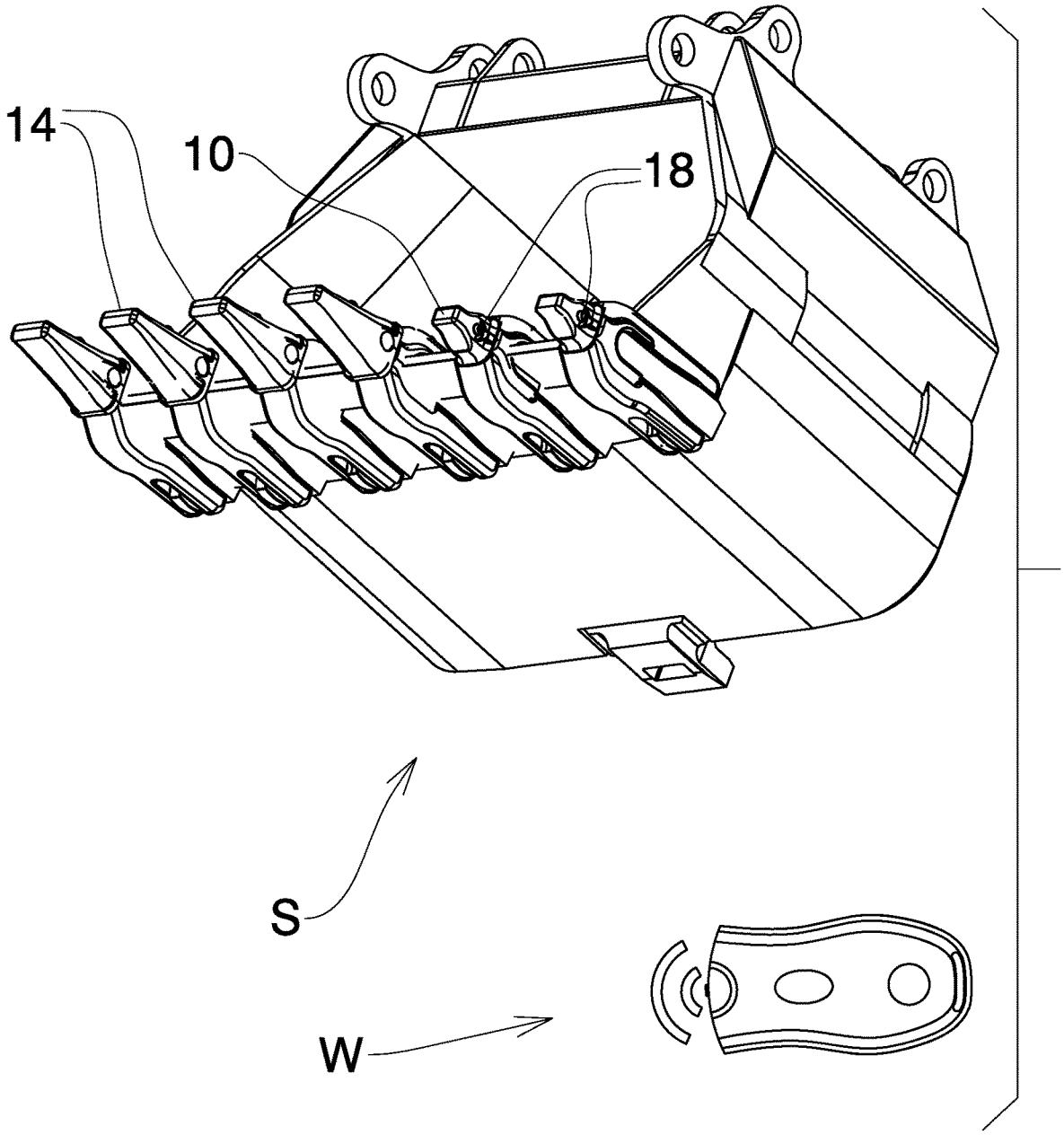
FIG. 9 is a schematic perspective of a shovel and remote controller to which the invention relates.

Such machinery has some kind of shovel or scrapers, (FIG. 9).

The lip of such a shovel is provided with teeth.

To secure the teeth, the shovel lip will have a series of mounting members. These may be themselves removable adaptors, or may be welded to the lip at spaced intervals. There may be twenty such mounting members on a shovel, for example, the number depending on the size, and the design of such a shovel. These mounting members usually carry removable adaptors. Teeth are then secured on the adaptors. In most case both the adaptors, and also the teeth are held on the shovel by some kind of lock or wedge. These typical locks or wedges are exposed at least in part to the outside environment around the teeth and adaptors. As a result, during use of the shovel, these locks and wedges are exposed to extreme wear and stresses as the shovels are moved into the earth, and when the earth is tipped out if the shovel, for example. When teeth, or even adaptors, become damaged or worn they must be replaced. This involves removing the wedge, discarding the damaged component and replacing it with a new one.

Often the wedge itself is damaged or difficult to dislodge.

In a typical shovel there may be for example twenty separate adaptors, carrying twenty separate teeth. The locking devices can be such that they will fit both the locking of the adaptors on the shovel mounting members, and also locking of the teeth on the adaptors.

The present invention provides a locking device for such a purpose, i.e. locking either teeth on their adaptors, or locking the adaptors on tool mounts on the shovel. Each locking device is concealed within the adaptor or tooth or tool mount and is self-contained and carries its own internal power operated mechanism.

The teeth and adaptors are formed with internal cavities or recesses. One of the cavities will receive the locking device within it, in the interior of the adaptor or mount. The other tool, either the adaptor or the tooth itself, is provided with an interior socket, which will register with the interior cavity formed in the mount or adaptor. By wireless remote technology, the locking device can be activated so as to lock the adaptor on the mount, or to lock the tooth on the adaptor. The locking devices themselves remain entirely concealed within the mount or adaptor, and are therefore protected from damage in use in the environment.

The internal power operated mechanism incorporates known wireless technology, and can be activated by a wireless remote control.

Figure 1:
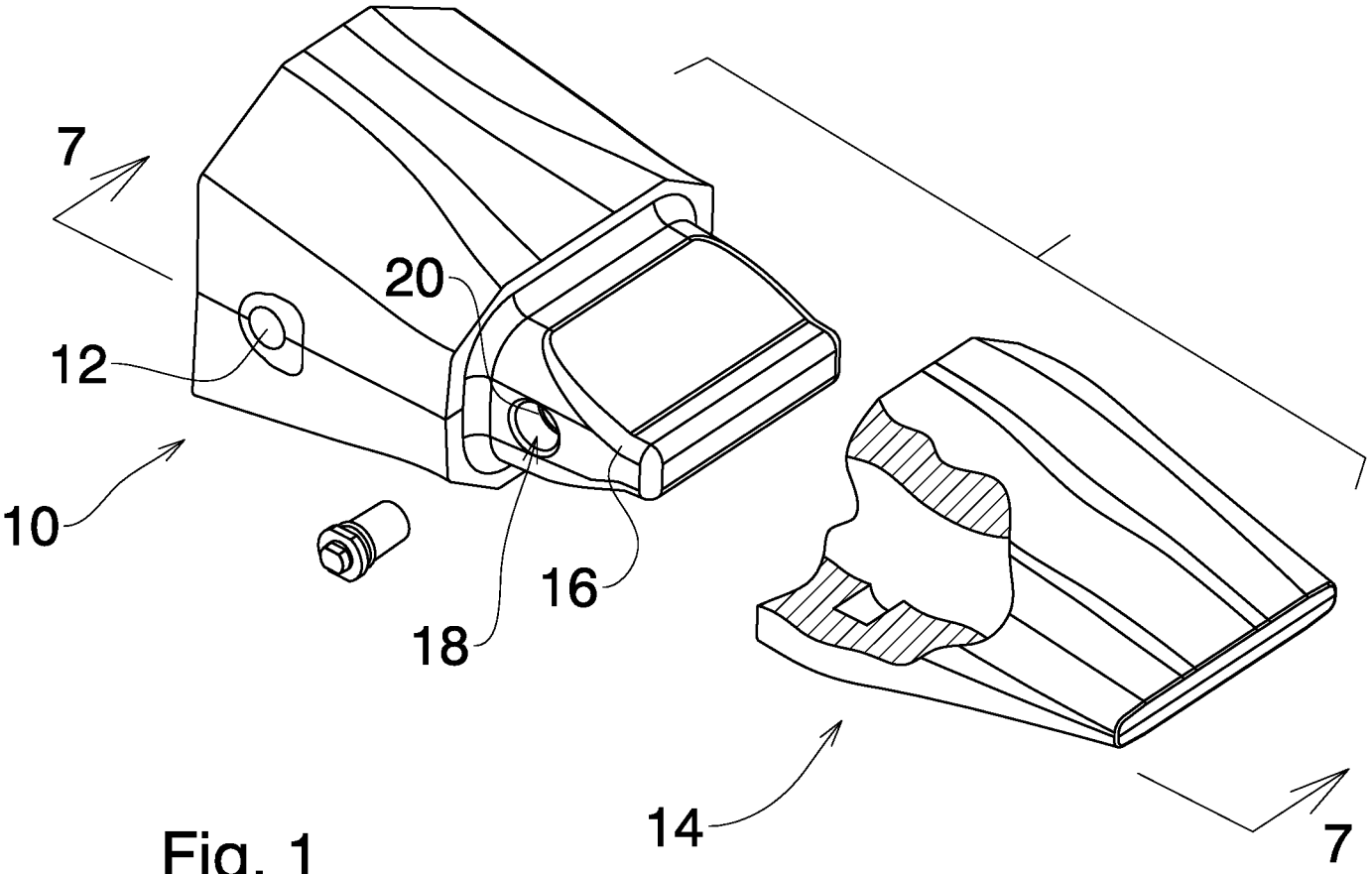
FIG. 1 is an exploded view of an adaptor, and the tooth; and the locking device.
Figures 2, 3:
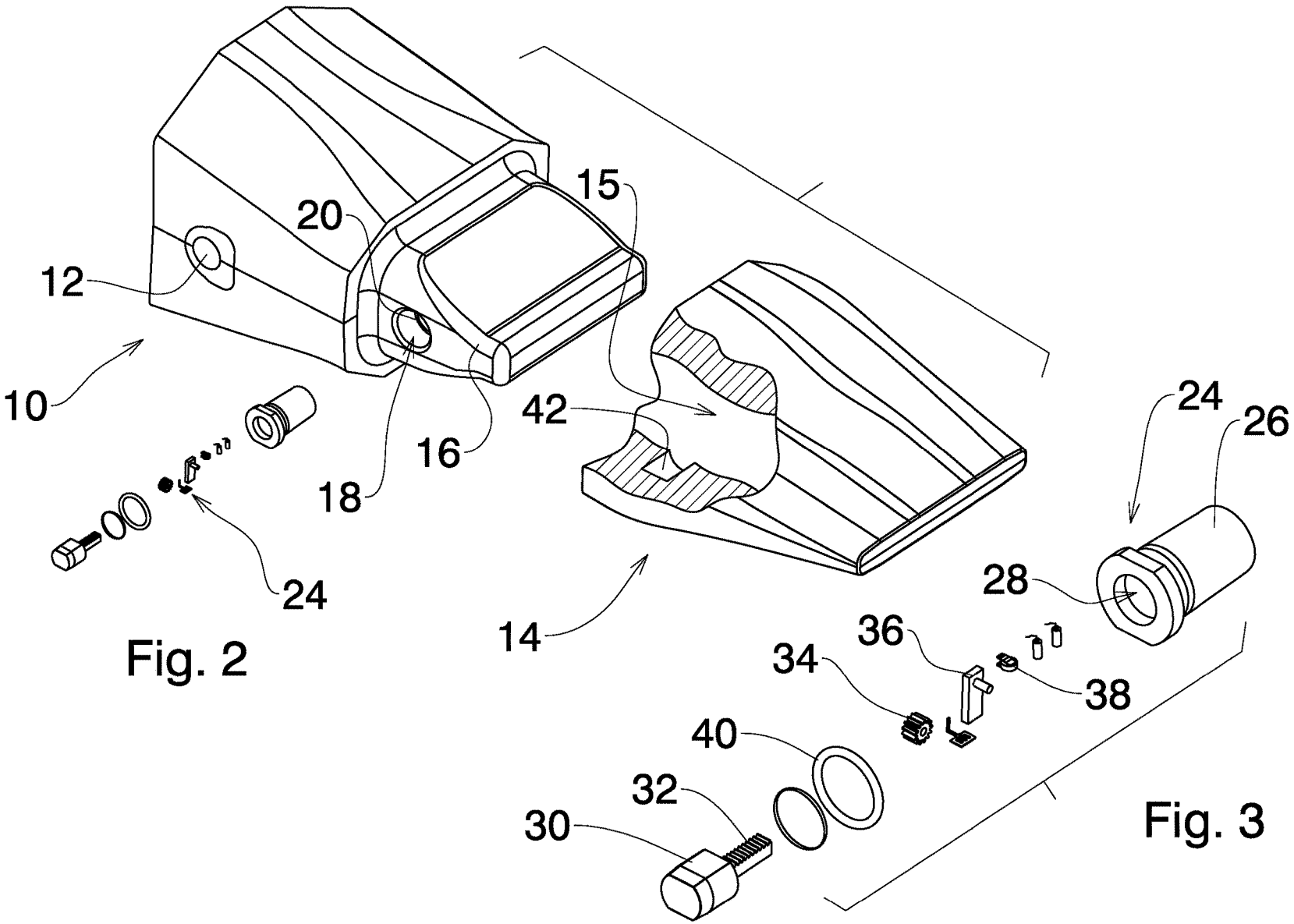
FIG. 2 is a view corresponding to FIG. 1 showing the locking device exploded.
FIG. 3 is an enlarged exploded view of the locking device of FIG. 2.
Figure 4:
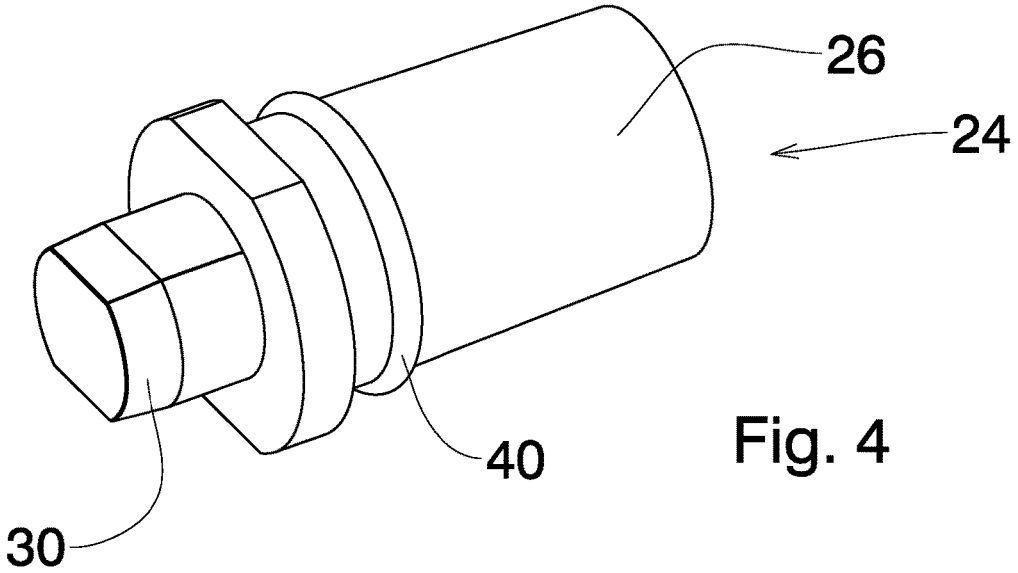
FIG. 4 is a perspective of the locking device.
Figure 6:
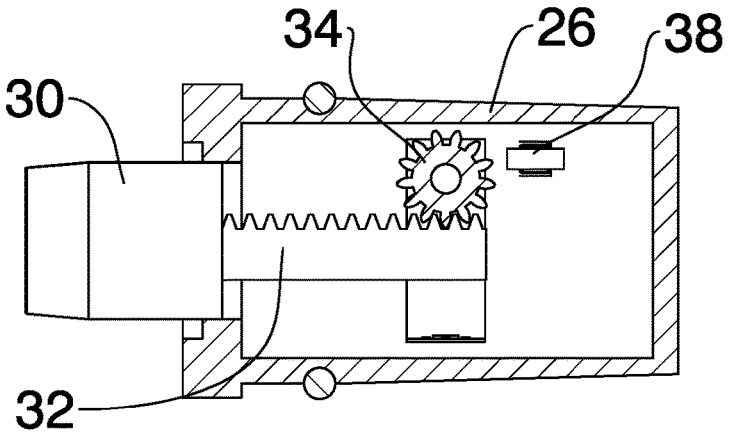
FIG. 6 is a section along 6-6 of FIG. 5.
Figure 5:
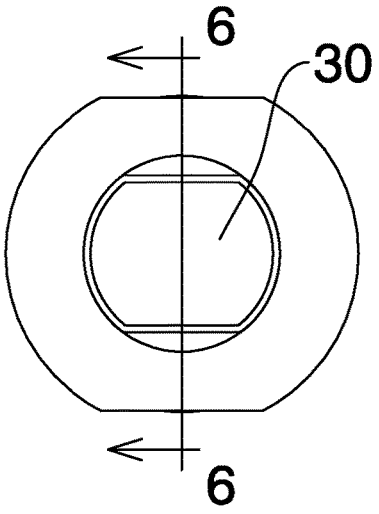
FIG. 5 is an end elevation of the locking device.

FIG. 1 shows an adaptor (10), typically such as can be secured on a support member on a shovel (FIG. 9). This adaptor (10) is of the type that can itself be removed from the shovel support member and replaced as needed. The adaptor (10) has a lock recess (12) to receive any suitable lock (not shown), by which the adaptor may be locked on the shovel support member.

The adaptor (10) in this case is designed to support a tooth (14). The tooth (14) has a hollow interior (15) which fits over the leading portion (16) of the adaptor (10).

The leading portion (16) of the adaptor has a body with a transverse cylindrical lock receiving recess (18), in one side.

The adaptor body has a longitudinal axis, extending in the direction of the shovel movement. The cylindrical lock receiving recess is located on an axis normal to longitudinal axis. In this way the locking device will extend outwardly and inwardly in a transverse direction to the axis of the adaptor.

The recess (18) has a rim (20) with two linear portions.

The tooth (14) has a hollow body (15) with an interior hidden lock receiving socket (42) within the hollow body.

A locking device (24) fits within the interior recess (18) of adaptor (10).

The locking device (24) is shown in more detail in FIGS. 2 to 6.

The locking device (24) has a generally cylindrical body (26), defining a hollow interior (28). A sliding lock member (30) of partly cylindrical shape is slidable within the interior (28) of body (26). The lock member (30) is attached to a linear gear rack (32) formed with gear teeth.

A drive gear (34) engages the gear teeth on the rack (32). Gear (34) is driven by an electric motor (36). Motor (36) is controlled and powered by circuits and battery (38), located within the interior of body (26).

Sealing rings (40) are provided as needed on body (26).

Figure 7:
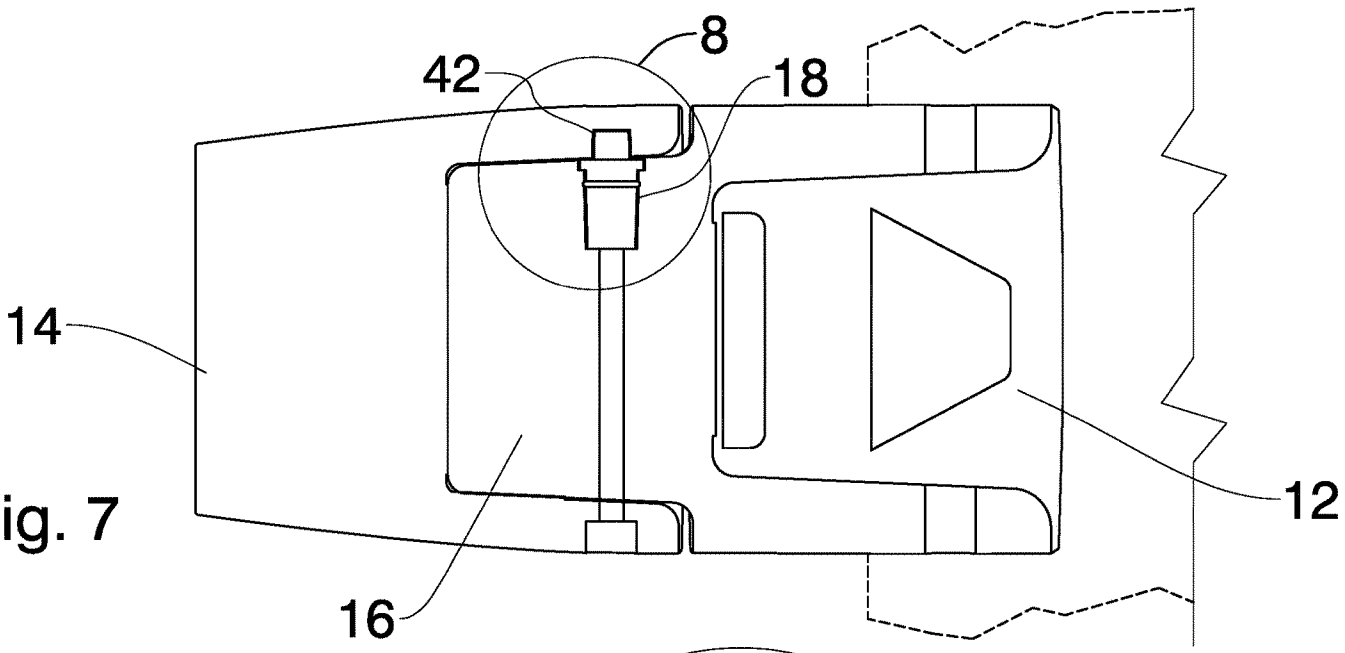
FIG. 7 is a section along line 7-7 of FIG. 1.
Figure 8:
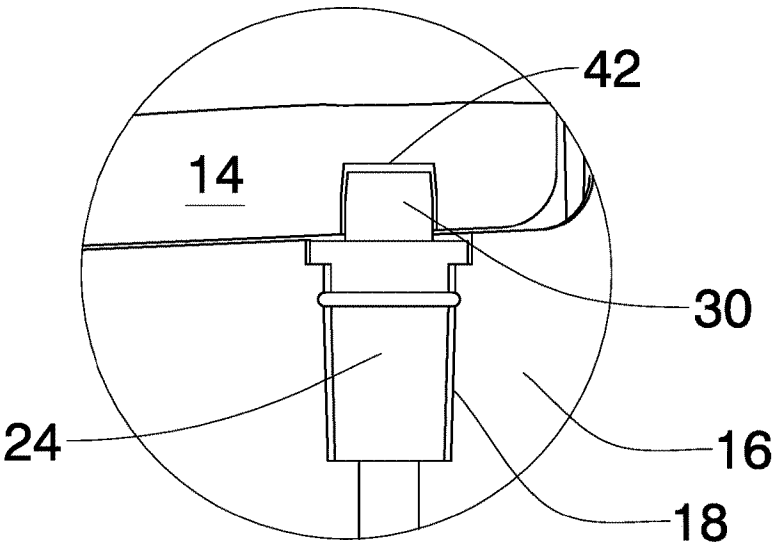
FIG. 8 is an enlarged detail of circle 8 of FIG. 7.

Tooth (14) has a hollow interior (15) (FIG. 7) which fits over the leading end (16) of adaptor (10). Tooth (14) is formed with an interior lock receiving socket (42) in one side of the hollow interior of tooth (14), and is inaccessible from the exterior of the tooth (14). When the tooth (14) is fitted over the leading end (16) of the adaptor (10), the socket (42) is located so as to align with interior recess (18) of adaptor (10) and receive locking member (30).

Again, the socket (42) in the tooth is aligned transverse to the longitudinal axis of the tooth. Thus when the tooth is fitted over the adaptor, the recess (18) and the socket (42) are both aligned with one another and are aligned transverse to the longitudinal axis of the tooth and the adaptor.

Small diameter access drillings (44) are formed in adaptor (10) and in tooth (14), aligned with one another. Drillings (44) connect with the inner end of recess (18) to enable service persons to reach the locking device (24) from outside the tooth (14).

It will thus be seen that the locking device (24) is entirely concealed within the body of the adaptor (10), and the tooth (14), and is not exposed on the exterior of either. In this way, the service life of the locking device (24) is greatly extended, and in practice it's operation by remote wireless technology, enables much quicker attention to servicing of the teeth on the shovel.

In operation the locking device is first inserted in the cylindrical recess (18) of the adaptor (10), with its lock member (30) retracted.

The tooth is then fitted over the leading end (16) of the adaptor (10). The tooth is slid on the adaptor (10) until the lock receiving recess (18) aligns with and registers with the lock receiving socket (42). At this point, the locking device is entirely concealed within and protected by the body of the adaptor (10), and is inaccessible manually from the exterior of the adaptor (10) or the tooth (14). Using a suitable remote wireless device (W) (FIG. 9) the motor (36) is then activated. The gear (34) rotates and moves the lock member (30) out of the body (26). The lock member will enter lock receiving socket (42) of the tooth (14) locking the tooth in position on the adaptor.

In order to remove the tooth, the motor is then activated in reverse. This will retract the lock member (30) from the lock receiving socket (42) in the tooth back into the body (26).

The tooth can then be removed from the adaptor.

Locking of the adaptor on its shovel using such a locking device (24) will involve essentially the same operations.

It will be appreciated that the power operated lock as described is capable of attaching removable attachments on earth moving machinery, whether such removable device is a tooth adaptor, or is a tooth itself, or of some other nature. Reference is therefore made in the claims to a releasable tool bit, it being the intention that this wording is generic to both the adaptor, and the tooth itself.

It is believed that the wireless technology involved in controlling each individual tooth lock, is well-known in the electronics art and requires no special description. It will, of course, be understood that each lock shall have its own unique signal. The operator of the equipment will have a hand-held device (W) capable of sending the separate individual signals, coded for the specific tool locks on the equipment.

The method of the invention is self-explanatory from the above.

Thus the locking of the tooth on the adaptor, or the locking of the adaptor on the support on the shovel, takes place by simply operating the hand held device (W), and moving the locking member along an axis which is transverse to the axis of the tooth or the adaptor. This is achieved without hammering of the tooth or the adaptor, or attempting to operate a threaded locking device or wedge, as was the case in earlier shovels.

While the recess (18) is shown in the adaptor, and the lock socket in the tooth, this arrangement could be reversed in some cases.

It will also be appreciated that while extensive reference has been made to ground engaging system and earth moving equipment, the invention is not necessarily limited solely to earth moving equipment. Other forms of power operated scoops and lifting devices are used, for example, when clearing a construction site, or removing debris from a collapsed building, to give only a few examples.

The foregoing is a description of preferred embodiments of the invention only, and is not thereby limited to such embodiments.

What is claimed is:

1. A shovel for earth moving equipment of the type having a shovel lip and a plurality of ground engaging tool bits removably attached to said lip and comprising:

a plurality of tool bit mounts on said shovel hp:

a plurality of tool bits releasably carried on respective said tool bit mounts, said tool bits each defining a hollow interior cavity adapted to fit over respective said tool bit mounts;

a lock receiving recess in each said tool bit mount;

power operated tool bit locks received in respective said lock receiving recesses, said power operated tool bit locks incorporating a moveable lock member, and an electrical power operated drive operable to drive said lock member between two positions; a lock receiving socket accessible within said hollow interior of each said tool bit, and oriented to register with a respective said lock receiving recess: and, a remote control device operable to signal respective said electrical power operated drives.

2. The shovel for earth moving equipment as claimed in claim 1 wherein a drive gear rack is attached to each said moveable lock member, a drive gear connected with said gear rack, and an electrical motor coupled to said drive gear, located within said power operated tool bit lock.

3. The shovel for earth moving equipment as claimed in claim 2 wherein said power operated tool bit lock is contained entirely within the tool bit mount, and wherein said moveable lock member is moveable by remote operation of said electrical motor and drive gear, to move said lock member into and out of engagement in said lock receiving socket in said tool bit.

4. The shovel for earth moving equipment as claimed in claim 3 wherein said tool bit mounts are fastened securely to said shovel.

5. The shovel for earth moving equipment as claimed in claim 3 including tooth adaptors removably attached to respective said tool bit mounts.

6. The shovel for earth moving equipment as claimed in claim 3 wherein respective teeth are mounted on respective said tool bit mounts on said shovel.

7. The shovel for earth moving equipment as claimed in claim 3 including lock recesses formed in respective said tool bit mounts, said lock recesses being formed in side portions of said tool bit mounts, and along axes normal to the longitudinal axis of each said tool bit mount, and wherein said lock receiving sockets are formed interiorly in each said tool bit, aligned along axes normal to the longitudinal axis of each said tool bit, and located whereby to be aligned with respective said lock recesses in said tool bit mounts when said tool bit is slid over said tool bit mount.

8. A remotely operable power operated tool lock for securing a tool bit on a tool bit mount on a ground engaging system said tool lock being concealed wholly within a tool bit mount and tool bit, and comprising:

a lock housing body adapted to be placed in one of said tool bit, and said tool bit mount of said ground engaging system;

a lock member slideably secured in said lock housing body;

a drive transmission means connected to said lock member, operable to extend and retract said lock member relative to said lock housing body; a wireless responsive electrical motor operable to control said drive transmission means; and, a remote wireless controller operable to send a specific coded signal to each said tool lock, and operate its respective said wireless responsive electrical motor; and wherein said tool bit mount defines a tool bit support and a lock receiving recess, and wherein said tool bit defines a hollow interior adapted to fit over said tool bit support and a lock receiving socket accessible within said hollow interior of said tool bit, for receiving said lock member from said lock housing body.

9. The power operated tool lock as claimed in claim 8 and wherein said lock member is attached to a gear rack, and including a drive gear engaged with said gear rack, said drive gear being responsive to operation of said motor for extension and retraction of said lock member relative to said lock housing body.

10. The power operated tool lock as claimed in claim 9 wherein said tool bit mounts are fastened securely to said ground engaging system.

11. The power operated tool lock as claimed in claim 10 including tool bit adaptors removably attached to respective said tool bit mounts.

12. The power operated tool lock as claimed in claim 11 wherein respective tool bits are mounted on respective said tool bit mounts.

13. The power operated tool lock as claimed in claim 11 wherein respective tool bits are mounted on respective said tool bit adaptors.

14. The power operated tool lock as claimed in claim 12 including lock recesses formed in respective said tool bit mounts, said lock recesses being formed in side portions of said tool bit mounts, and along axes normal to the longitudinal axis of each said tool bit mount, and wherein said lock receiving sockets are formed interiorly in each said tool bit aligned along axes normal to the longitudinal axis of said tool bit, and located whereby to be aligned with a respective said lock recesses in said tool bit mount when said tool is slid over said tool bit mount.

15. A method of remotely securing a tool hit on a tool bit mount on a ground engaging shovel and comprising:

forming said tool bit mount with an internal lock receiving recess;

forming a tool bit with a hollow interior defining a lock receiving socket;

placing a tool lock in said recess in said tool bit mount, said tool lock having a lock member, slideably secured in a lock housing body, and operable in response to an internally located electrical motor, to move said lock member, remotely controlling said electrical motor by means of a remote wireless controller operable to send a specific coded signal to said tool lock for operation of said electrical motor; and further including the steps of placing said tool bit lock in said recess in said tool bit mount, placing a tool bit defining a hollow interior over said tool bit mount and over said tool lock, said tool bit defining a hollow interior with a lock receiving socket, aligning said lock receiving socket with said tool lock housing recess in said tool bit mount, and operating said wireless responsive motor by a remote wireless controller exterior to said tool bit mount and said tool bit.

* * * * *